US007686569B2

(12) United States Patent
Paprotna et al.

(10) Patent No.: US 7,686,569 B2
(45) Date of Patent: Mar. 30, 2010

(54) BLADE CLEARANCE SYSTEM FOR A TURBINE ENGINE

(75) Inventors: Hubertus Edward Paprotna, Winter Springs, FL (US); Oran Bertsch, Titusville, FL (US)

(73) Assignee: Siemens Energy, Inc., Orlando, FL (US)

( * ) Notice: Subject to any disclaimer, the term of this patent is extended or adjusted under 35 U.S.C. 154(b) by 593 days.

(21) Appl. No.: 11/633,396

(22) Filed: Dec. 4, 2006

(65) Prior Publication Data

US 2008/0131270 A1 Jun. 5, 2008

(51) Int. Cl.
*F01D 11/20* (2006.01)

(52) U.S. Cl. ..... 415/1; 415/127; 415/128; 415/135; 415/138; 415/173.1

(58) Field of Classification Search ..... 415/1, 415/126, 127, 128, 134, 135, 138, 173.1, 415/173.2, 173.3

See application file for complete search history.

(56) References Cited

U.S. PATENT DOCUMENTS 3,854,843 A * 12/1974 Penny ..... 415/197
3,986,720 A 10/1976 Knudsen et al.
4,247,247 A * 1/1981 Thebert ..... 415/113
4,289,446 A 9/1981 Wallace
4,332,523 A * 6/1982 Smith ..... 415/126
4,334,822 A * 6/1982 Rossmann ..... 415/113
4,482,293 A * 11/1984 Perry ..... 415/14
4,632,635 A 12/1986 Thoman et al.
4,863,345 A * 9/1989 Thompson et al. ..... 415/174.1
5,203,673 A 4/1993 Evans
5,330,320 A 7/1994 Mansson
5,593,278 A 1/1997 Jourdain et al.
5,779,442 A 7/1998 Sexton et al.
5,871,333 A 2/1999 Halsey
5,906,473 A 5/1999 Sexton et al.
6,422,807 B1 7/2002 Leach et al.
6,672,831 B2 * 1/2004 Brandl et al. ..... 415/173.2
6,918,743 B2 7/2005 Gekht et al.
2002/0071762 A1 6/2002 Schroder
2005/0042077 A1 2/2005 Gekht et al.
2005/0069406 A1 3/2005 Turnquist et al.
2005/0129499 A1 6/2005 Morris et al.

* cited by examiner

*Primary Examiner*—Igor Kershteyn

(57) ABSTRACT

A blade gap control system configured to move a blade ring of a turbine engine relative to a blade assembly to reduce the gaps between the tips of the blades and the blade rings to increase the efficiency of the turbine engine is provided. The blade rings can be at an acute angle with respect to the rotational axis of the blade assembly. The axial movement of the blade ring can be done by a pressure differential supplied across the blade ring, the thermal expansion and/or contraction of a linkage or by a piston.

18 Claims, 7 Drawing Sheets

BLADE CLEARANCE SYSTEM FOR A TURBINE ENGINE

FIELD OF THE INVENTION

This invention is directed generally to turbine engines, and more particularly to systems for reducing the gap between the tips of rotatable blades and blade rings.

BACKGROUND

Typically, gas turbine engines include a compressor for compressing air, a combustor for mixing the compressed air with fuel and igniting the mixture, and a blade assembly for producing power. Combustors often operate at high temperatures that may exceed 2,500 degrees Fahrenheit. Typical turbine combustor configurations expose blade assemblies to these high temperatures. As a result, blades must be made of materials capable of withstanding such high temperatures. Blades and other components often contain cooling systems for prolonging the life of the blades and reducing the likelihood of failure as a result of excessive temperatures.

Blades typically extend radially from a rotor assembly and terminate at a tip within close proximity of the blade rings (in the compressor section) or ring segments (in the turbine section). In the turbine section, the ring segments are mounted to the blade rings and may be exposed to the hot combustion gases and, similar to the blades, the ring segments often rely on internal cooling systems to reduce stress and increase the life cycle. The blade rings or ring segments are spaced radially from the blade tips to create a gap therebetween to prevent contact of the blade tips with the blade rings as a result of thermal expansion of the blades. During conventional startup processes in which a turbine engine is brought from a stopped condition to a steady state operating condition, blades and blade rings pass through a pinch point at which the gap between the blade tips and the blade rings is at a minimal distance due to thermal expansion. The blade tips of many conventional configurations contact or nearly contact the blade rings. Contact of the blade tips may cause damage to the blades. Furthermore, designing the gap between the blade tips and the blade rings for the pinch point often results in a gap at steady state conditions that is larger than desired because the gap and combustion gases flowing therethrough adversely affect performance and efficiency.

As shown in FIGS. 1 and 2, the compressor section 10 of a turbine engine is enclosed within an outer casing 12. The compressor can include a rotor (not shown) with a plurality of axially spaced discs 14. Each disc 14 can host a row of rotating airfoils, commonly referred to as blades 16. The rows of blades 16 alternate with rows of stationary airfoils or vanes 18. The vanes 18 can be provided as individual vanes, or they can be provided in groups such as in the form of a diaphragm. The vanes 18 can be mounted in the compressor section 10 in various ways. For example, one or more rows of vanes 18 can be attached to and extend radially inward from the compressor shell 12. In addition, one or more rows of vanes 18 can be hosted by a blade ring or vane carrier 20 and extend radially inward therefrom.

The compressor section 10 contains several areas in which there is a gap or clearance 22 between the rotating and stationary components. During engine operation, fluid leakage through clearances 22 in the compressor section 10 contributes to system losses, making the operational efficiency of a turbine engine less than the theoretical maximum. Small clearances are desired to keep air leakage to a minimum; however, it is critical to maintain a clearance between the rotating and stationary components at all times. Rubbing of any of the rotating and stationary components can lead to substantial component damage, performance degradation, and extended outages. The size of each of the compressor clearances can change during engine operation due to the difference in the thermal inertia of the rotor and discs 14 compared to the thermal inertia of the stationary structure, such as the outer casing 12 or the vane carrier 20. Because the thermal inertia of the vane carriers 20 are significantly less than the rotor, the vane carrier 20 has a faster thermal response time and responds (through expansion or contraction) more quickly to a change in temperature than the rotor.

Compressor clearance pinch point typically occurs during a hot restart which is a restart of the turbine engine within about thirty minutes after shut down. During the hot restart, the immediate inflow of cool ambient air makes the blade ring contract radially inward faster than the rotor thereby creating the pinch point.

Thus, there is a need for a clearance control system that reduces or minimizes leakage. There is a further need for such a system that avoids contact of the rotating and stationary components.

SUMMARY OF THE INVENTION

The present disclosure is directed to a blade gap control system for reducing a gap formed between blades and blade rings or ring segments in turbine engines. Reducing the gap increases the efficiency of the turbine engine by reducing the amount of combustion gases flowing around the blades rather than being compressed by or otherwise flowing through the blades. The blade gap control system may be configured to enable the turbine engine to go through start up conditions, through a pinch point where the tips of the blades are closest to the blade rings and into a steady state condition. The blade gap control system may be configured to reduce the size of the gap at various operating conditions by moving the blade rings relative to the blade tips. Axial movement of the blade rings relative to the blade tips reduce the gap between the tips of blades and blade rings in turbine engines in which the tips of the blades are positioned at an acute angle relative to a rotational axis and the blade rings are positioned in a similar manner.

In one aspect, a blade clearance control system for a turbine engine having an outer casing and a rotor assembly is provided. The system has a blade ring concentric with the rotor assembly and positioned radially outward from blade tips of the rotor assembly. The blade ring has a radially inner wall that is radially outward of the blade tips to define a gap therebetween. The system also has one or more upstream plenums and one or more downstream plenums positioned upstream and downstream, respectively, of the blade ring. The one or more upstream and downstream plenums are selectively pressurized to move the blade ring relative to the blade tips to adjust the gap.

In another aspect, a turbine engine may include an outer casing, a blade assembly, one or more blade rings and a gap control system. The blade assembly may be formed from one or more rows of blades extending radially from a rotor, with the at least one row being formed from a plurality of blades having blade tips. The one or more blade rings may be positioned radially outward of the blade assembly, with a radially inner wall of each of the one or more blade rings being offset radially outward from the tips of the blades creating gaps. The one or more blade rings may be positioned at an acute angle with respect to a rotational axis of the blade assembly. The gap control system may have a first linkage that thermally expands or contracts to move the one or more blade rings axially relative to the blade tips to adjust the gaps.

In another aspect, a method of blade clearance control in a gas turbine may include positioning a blade ring concentric with a rotor assembly and radially outward from blade tips of the rotor assembly, positioning a radially inner wall of the blade ring oblique to a rotational axis of the rotor assembly with the radially inner wall being radially outward of the blade tips to define a gap therebetween, and supplying a pressurized fluid to the blade ring to selectively create a pressure differential across a portion of the blade ring to move the blade ring relative to the blade tips to adjust the gap.

The radially inner wall of the blade ring can be oblique to a rotational axis of the rotor assembly, and the one or more upstream and downstream plenums may move the blade ring axially relative to the blade tips to adjust the gap. The system may also have at least one guide pin. The blade ring may have a post that is slideably connected to the guide pin. The one or more upstream and downstream plenums can be defined in part by a radially outer wall of the blade ring. The blade ring may be a plurality of blade ring segments.

The one or more upstream and downstream plenums can be first and second plenums, with the first and second plenums being selectively pressurized to move the blade ring axially relative to the blade tips to adjust the gap. The radially inner wall of the blade ring can be at an acute angle with respect to the rotational axis and can be substantially equal to a tip angle defined by the blade tips and the rotational axis. The blade clearance control system can be in the compressor section of the turbine engine and can also be in the turbine section. The gap control system may have a second linkage, with the first linkage being pivotally connected at one end to the outer casing and at the other end to the second linkage. The second linkage can amplify the thermal expansion or contraction of the first linkage.

The first linkage may be a high alpha material. The first linkage may be a shape memory alloy. The method of blade clearance control can include aligning the radially inner wall of the blade ring and the blade tips at a substantially equal acute angle with respect to the rotational axis of the rotor assembly. The method of blade clearance control may include slideably connecting the blade ring to an outer casing of the gas turbine.

An advantage of this invention is that the blade gap control system enables blades to be brought through a pinch point without the blade tips contacting the blade rings and enables the gaps between the blades tips and the blade rings to be reduced at steady state operating conditions to increase the efficiency of the engine.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
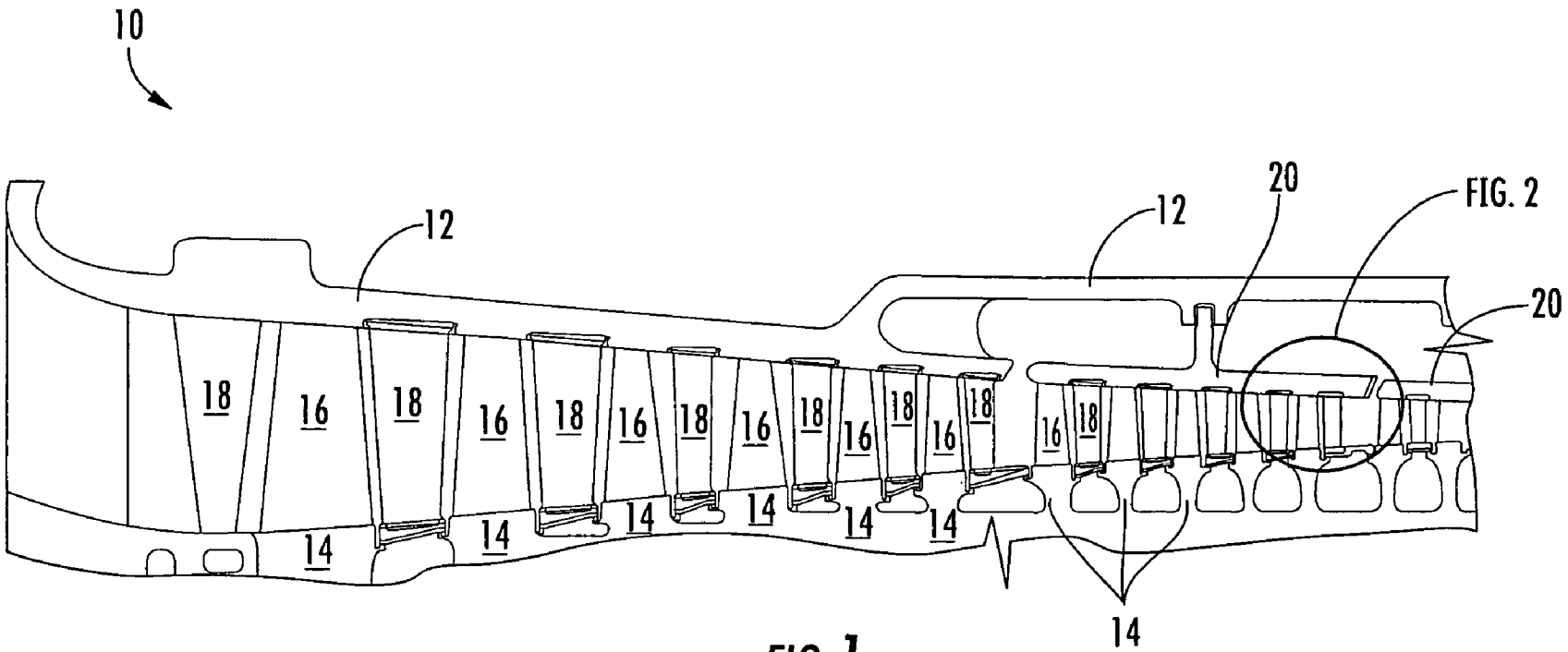
FIG. 1 (PRIOR ART)
FIG. 1 is a cross-sectional view of a compressor section of a contemporary turbine engine.
Figure 2:
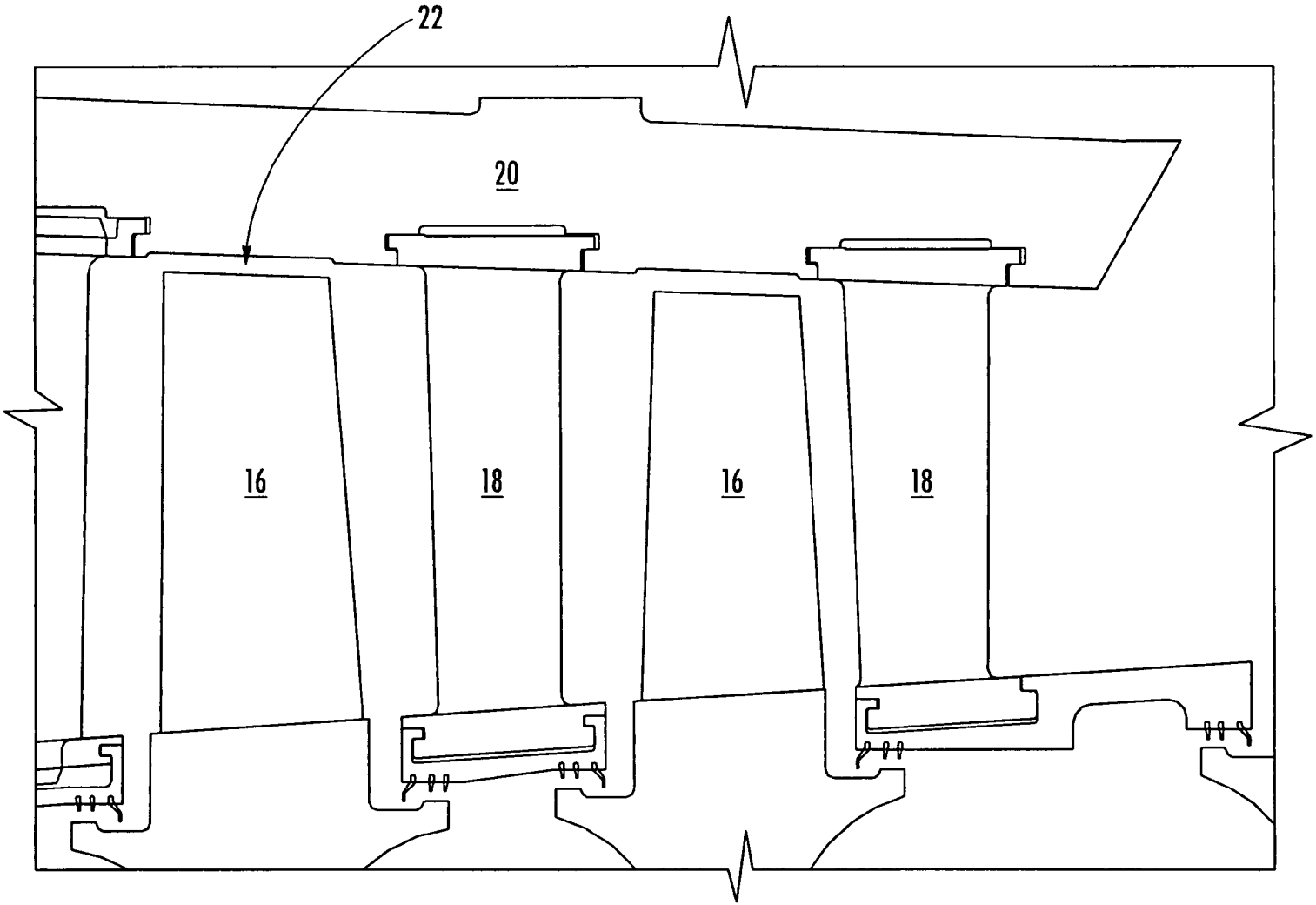
FIG. 2 (PRIOR ART)
FIG. 2 is a detailed view of a portion of the compressor section of FIG. 1, showing the various compressor blade clearances.

Embodiments of the present invention address the shortcomings of prior blade tip clearance or gap control systems by providing a blade ring adapted for movement relative to the blade tips. Exemplary embodiments will be explained in connection with various possible clearance control systems and methods, but the detailed description is intended only as exemplary. Exemplary embodiments will be shown in FIGS. 3-8, but the present disclosure is not limited to the illustrated structure or application.

Referring to FIGS. 3-6, a first exemplary embodiment of a blade gap control system 100 may reduce a gap 112 formed between blades 114 and blade ring 116 in the turbine engine. Reducing the gap 112 increases the efficiency of the turbine engine by reducing the amount of air flowing around the blades 114 rather than being compressed by the blades 114. The blade gap control system 100 may be configured to enable the turbine engine 150 to go through start up conditions, through a pinch point before steady state operation where the tips 120 of the blades 114 are closest to the blade rings 116 and into a steady state condition.

The exemplary embodiment described herein, describes by way of example the blade gap control system 100 controlling blade clearance in the compressor section of the gas turbine 150. However, it should be understood that the present disclosure contemplates the use of the system 100 in other sections of the turbine engine for clearance control between rotating and stationary parts, including the turbine section.

Figure 5:
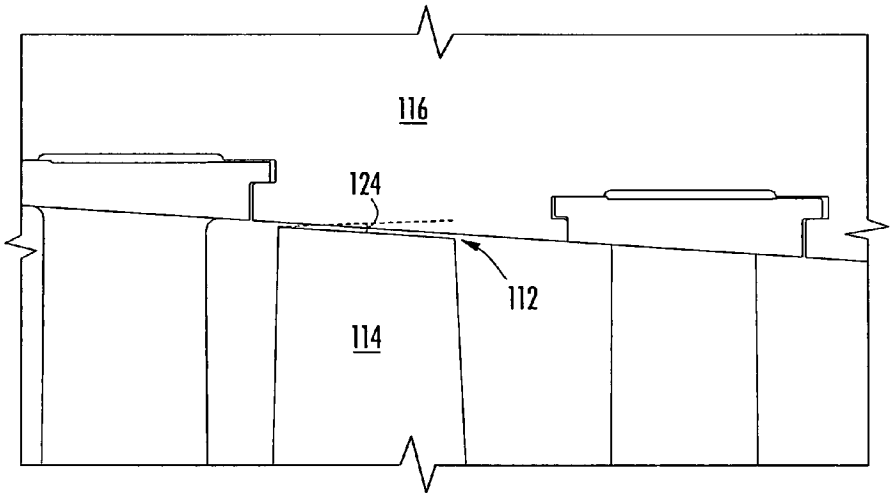
FIG. 5 is a detailed view of a portion of the blade assembly shown in FIG. 3, showing the blade clearance at a first axial position of the blade ring.

The blade ring or vane carrier 116 can be a single piece or can be a plurality of blade ring segments, such as, for example, two halves. It will be understood that aspects of the present disclosure can be applied to any of the clearance control systems described herein regardless of the configuration, and that the term "vane carrier" or "blade ring," as used herein, refers to any of such blade ring configurations. The blade gap control system 100 is configured to reduce the size of the gap 112 under various operating conditions by moving the blade rings 116 relative to the blades 114. The radially inner wall 117 of the blade rings 116 preferably has a conical or tapered shape and the blade tips 120 are preferably at a tip angle 124 with respect to the rotational axis of the turbine engine 150. The radially inner surface 117 of the blade rings 116 is preferably oblique or inclined relative to the rotational axis. This conical shape of radially inner wall 117 and the angle 124, as shown in FIG. 5, of blade tips 120 provide for increasing and reducing the gap 112 as the position of the blade rings 116 are axially adjusted relative to the blades 114. However, the present disclosure also contemplates movement of the blade rings 116 relative to the blade tips 120 in directions other than axially.

Figure 3:
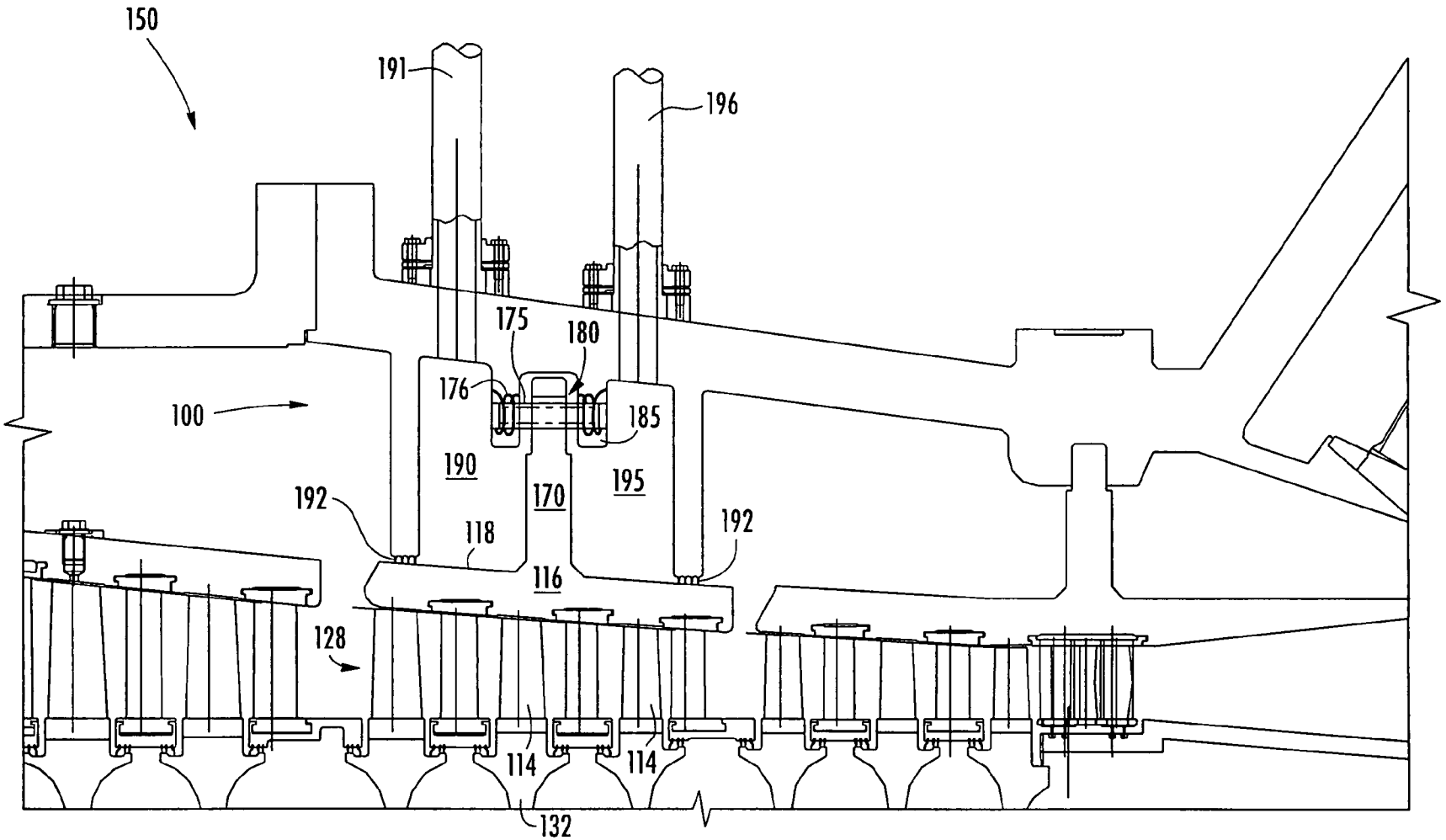
FIG. 3 is a partial cross-sectional view of a blade assembly having a blade gap control system according to a first exemplary embodiment of the invention.
Figure 4:
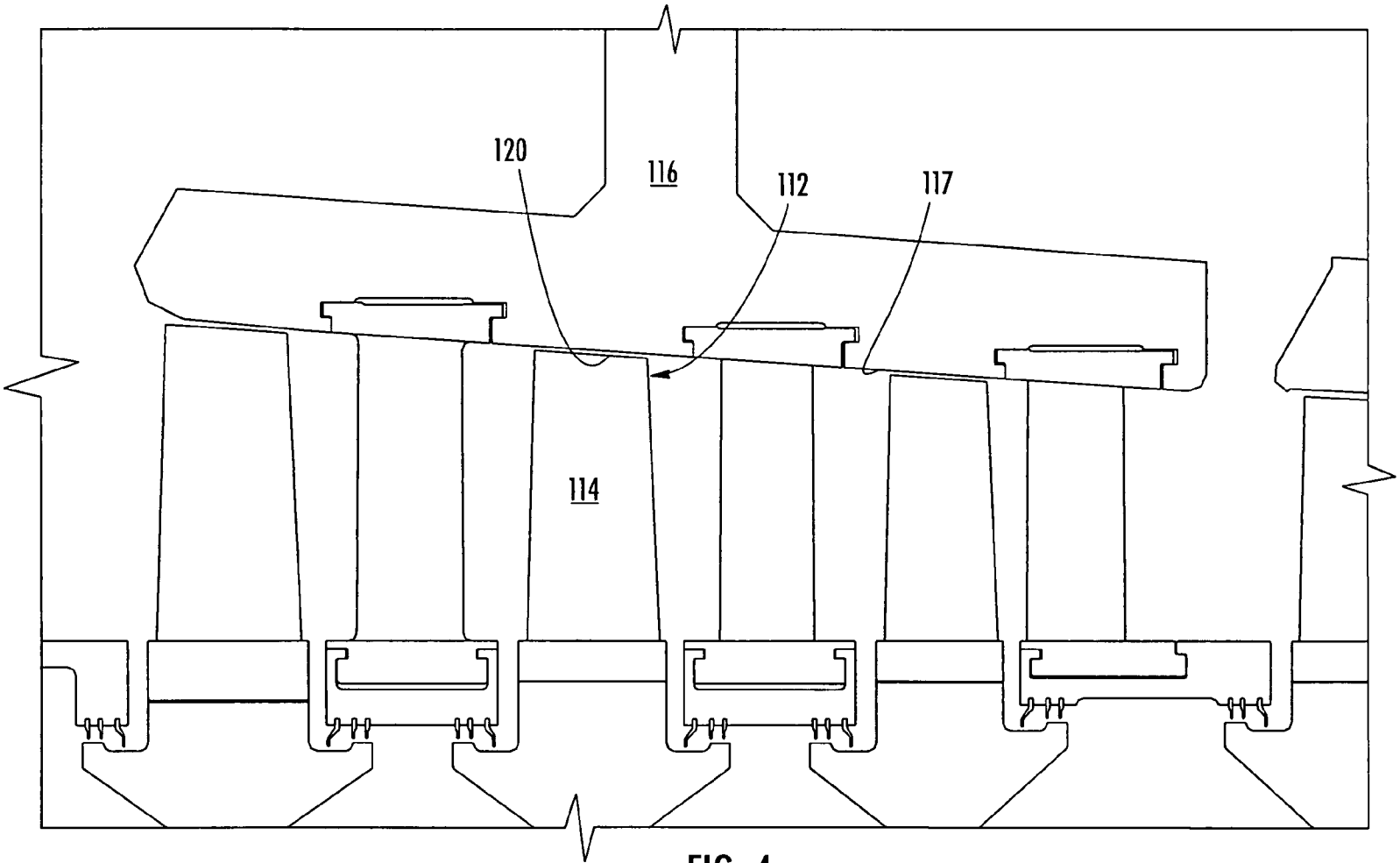
FIG. 4 is a detailed view of a portion of the blade assembly shown in FIG. 3.

As shown in FIG. 3, the turbine engine 150 may include a blade assembly 128 formed from a plurality of rows of blades 114 extending radially outward from a rotor 132. The rotor 132 may be any conventional rotor configured to rotate about the rotational or longitudinal axis. The blades 114 of a row may all extend substantially equal distances from the rotor 132 such that the tips 120 are positioned within close proximity of the blade rings 116, yet offset to form the gap 112. During operation, the rotor 132 rotates to compress the air via the blades 114.

The blades 114 may have tips 120 positioned at the acute angle 124 relative to a rotational axis of the blade assembly 128. The blade rings 116 may include radially inner surfaces 117 that are positioned substantially at the acute angle 124 relative to the rotational axis. However, radially inner surfaces 117 of the blade rings 116 and the blade tips 120 may have other positions as well.

The blade rings 116 may be moveably or slideably attached or otherwise guided along an outer casing 160 via a ring post, flange or support structure 170 formed thereon. Additional support structures can also be used in combination with guide members and the like. As shown in FIGS. 3-6, a slideable attachment of the blade rings 116 to the outer casing 160 is utilized via one or more guide pins 175 that slideably connect with corresponding openings 180 in the ring posts 170. The guide pins 175 can be connected to casing posts or support structures 185, which can facilitate assembly and removal of the blade rings 116 from the outer casing 160. Other slideable connection structures and methods between the blade rings 116 and the outer casing 160 may be used, such as, for example, bearings, journals and the like.

The slideable connection between the blade rings 116 and the outer casing 160 may include biasing members, such as, for example, springs 176 and the like, positioned between the ring post 170 and the casing post 185 to facilitate control of the position of the blade ring 116 relative to the blade tips 1.20. The present disclosure also contemplates other biasing structures, configurations and methodologies being utilized to facilitate control of the position of the blade ring 116 relative to the blade tips 120. Clearance control system 100 may utilize other structures and techniques to facilitate movement of the blade ring 116 relative to the blade tips 120 such as, for example, a lubricating system.

The blade rings 116 may be concentric with the rotor 132 and positioned radially outward from the blades 114. In such a position, axial movement of the blade rings 116 relative to the blade tips 120 causes an adjustment in the size of the gap 112.

To actuate axial movement of the blade ring 116, system 100 has upstream plenum 190 and downstream plenum 195 positioned on upstream and downstream sides, respectively, of ring post 170. The number, shape, size and configuration of plenums 190 and 195 can be chosen to facilitate the movement of the blade rings 116 relative to the blade tips 120. In the exemplary embodiment of system 100, plenums 190 and 195 are defined in part by outer casing 160. However, the present disclosure contemplates other structures being utilized to form the plenums 190 and 195.

The plenums 190 and 195 can be selectively supplied with a high pressure fluid, such as, for example, high pressure steam or air. The exemplary embodiment of FIGS. 3-6 shows supply lines 191 and 196 selectively providing the high pressure fluid to plenums 190 and 195. However, the present disclosure contemplates other structures and configurations for selectively providing the high pressure fluid to plenums 190 and 195. The particular source of the high pressure fluid can be chosen based upon the pressure that is required in the plenums 190 and 195 for movement of the blade ring 116. Seals 192 or other sealing structures can be positioned along a radially outer wall 118 of blade ring 116 so that the blade ring can axially move while maintaining an increased pressure in one of plenums 190 and 195. A labyrinth seals 192 may be used to seal the plenums 190 and 195, but other seals are contemplated by the present disclosure.

Increasing the pressure in the upstream plenum 190 relative to the pressure in the downstream plenum 195 causes movement of the blade ring 116 in an axially downstream direction, while increasing the pressure in the downstream plenum 195 relative to the pressure in the upstream plenum 190 causes movement of the blade ring 116 in an axially upstream direction. Control system 100 can adjust the position of the blade ring 116 relative to the blade tips 120 by adjusting the pressure differential between the upstream and downstream plenums 190 and 195. In control system 100, this is done by supplying and removing the high pressure fluid from the plenums 190 and 195 via supply lines 191 and 196. However, the particular structure, configuration and methodology used to adjust the pressure differential between the upstream and downstream plenums 190 and 195 can be varied to facilitate the control of the movement of the blade ring 116.

Supplying one of the plenums 190 or 195 with the high pressure fluid can increase the temperature in the plenum and result in heat transfer through radially outer wall 118 of the blade ring 116. This increase in temperature of the blade ring 116 may result in additional thermal expansion of the blade ring which is considered as a factor when adjusting the gaps 112. Additionally, by controlling the temperature of the pressurized fluid in the plenums 190 and 195, the radial expansion of the blade ring 116 can be controlled to assist in adjusting the gaps in combination with the axial movement of the blade ring.

Figure 6:
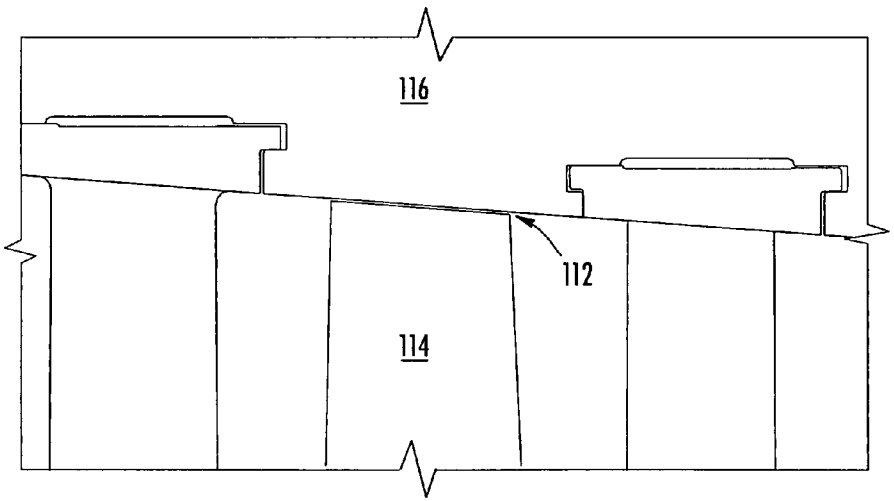
FIG. 6 is a detailed view of a portion of the blade assembly shown in FIG. 3, showing the blade clearance at a second axial position of the blade ring.

During use, the turbine engine 150 may be started and brought up to a steady state operating condition. As this occurs, the gap 112 between the blade rings 116 and the blade tips 120 can vary. Control system 100 can adjust the gap 116 to improve the efficiency of the turbine engine 150. For example, as shown in FIG. 5, gap 112 is relatively large. To reduce the leakage, control system 100 moves the blade ring 116 in an upstream direction which reduces the gap 112 as shown in FIG. 6. During pinch point operation, the axial position of the blade ring 116 relative to the blade tips 120 may be adjusted to increase the clearance, thereby preventing any rubbing of the blade tips with the blade ring. During base load operation, the axial position of the blade ring 116 relative to the blade tips 120 may be adjusted to decrease the clearance, thereby removing the inefficiencies due to leakage.

Control system 100 is particularly effective during a hot restart of the turbine engine where pinch point operation occurs. As shown in FIG. 5, control system 100 can move the blade ring 116 in a downstream direction to a first position which increases the gap 112 and prevents any rubbing as the pinch point occurs. Once base load operation resumes, control system 100 can move the blade ring 116 in an upstream direction to a second position which reduces the gap 112 as shown in FIG. 6.

The present disclosure also contemplates active control of the gaps 112 via monitoring of the gaps and by adjusting the pressure differential between the upstream and downstream plenums 190 and 195 to adjust the position of the blade ring 116 relative to the blade tips 120. Valves and other control devices can be incorporated into the control system 100 to provide for control of the pressure differential between the plenums 190 and 195.

Figure 7:
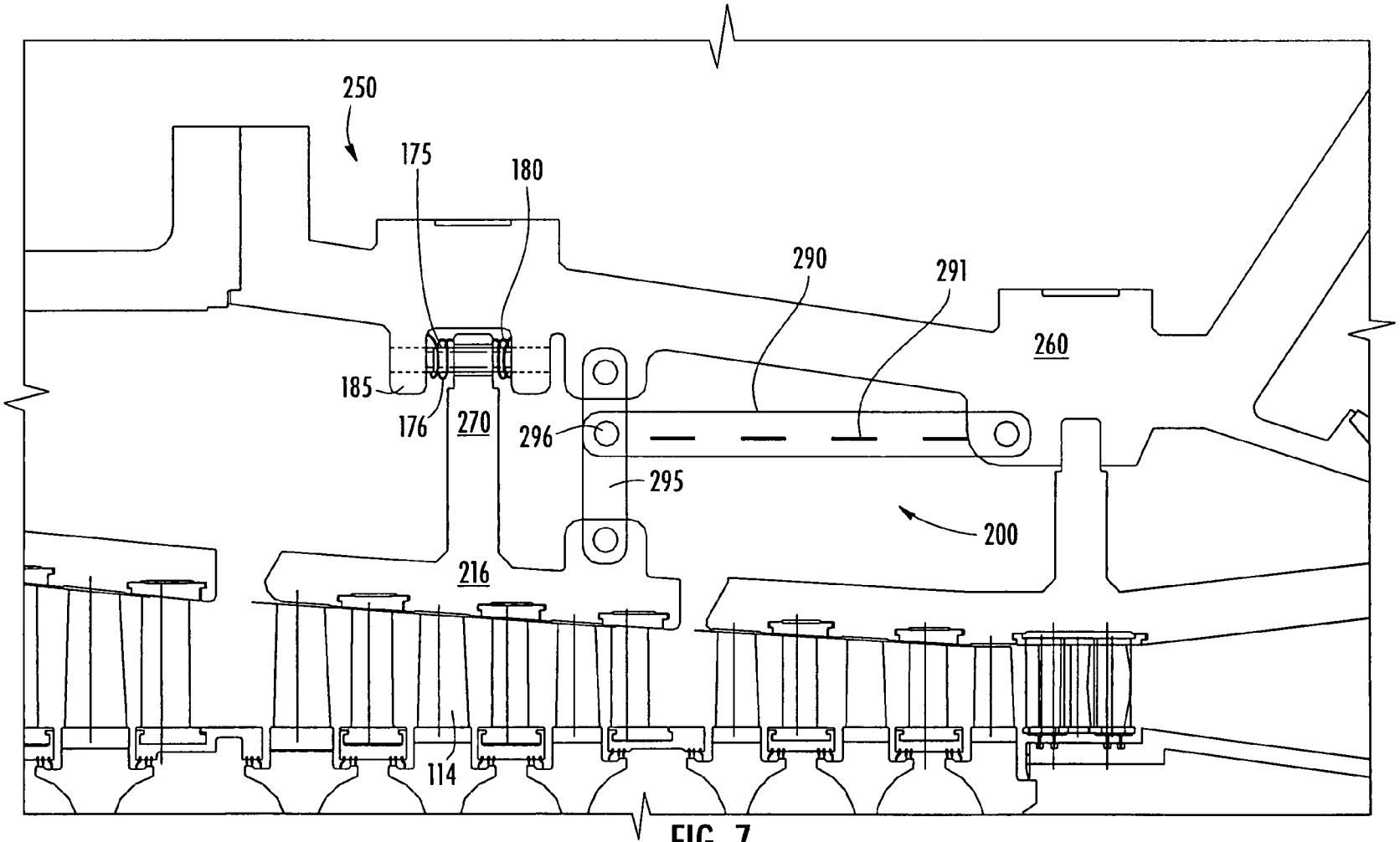
FIG. 7 is a partial cross-sectional view of a blade assembly having a blade gap control system according to a second exemplary embodiment of the invention.

Referring to FIG. 7, a second exemplary embodiment of a blade gap control system 200 may reduce the gap 112 formed between blades 114 and blade rings 216 in the turbine engine 250. The exemplary embodiment described herein, shows the blade gap control system 200 controlling blade clearance in the compressor section of the gas turbine. However, it should be understood that the present disclosure contemplates the use of the system 200 in other sections of the turbine engine for clearance control between rotating and stationary parts, including the turbine section. Additionally, blade rings 216 can be a single piece or a plurality of segments, and are moveably connected to the outer casing 260.

The slideable blade rings or vane carriers 216 are operably connected to an expandable linkage 290. Linkage 290 is made from a material with thermal expansion and/or contraction properties that will result in the desired movement of the blade ring 216. Linkage 290 can be a high alpha material exhibiting expansion and contraction properties that will facilitate movement of the guide ring 216. Linkage 290 may also be a shape memory alloy.

As the linkage 290 expands, blade ring 216 axially moves upstream which reduces the gap 112. As the linkage 290 contracts, blade ring 216 axially moves downstream which increases the gap 112. The particular material used for linkage 290 can be chosen so that the resulting expansion or contraction of the linkage adjusts the gap 112 to the desired size to effectively reduce or eliminate leakage while preventing rubbing of the blades 114 with the blade rings 216.

The particular configuration of the linkage 290 can be chosen based upon the properties of the linkage material. For example, where linkage 290 is a shape memory alloy that undergoes substantial plastic deformation and then returns to its original shape by the application of heat, the linkage can be positioned to adjust the position of the blade ring 216 based upon contraction occurring after application of heat.

The heat applied to linkage 290 can be from various sources including, but not limited to, passive heating, active heating, such as, for example, via high temperature air or steam, and/or electrical current. The use of electrical current as a source of heating obviates the need to remove thermal energy from the gas turbine engine.

The linkage 290 can have one or more heat fins 291 or other thermal communication structures. The number, size, shape and configuration of the heat fins 291 can be chosen to improve the efficiency of heat transfer. By improving the efficiency of the heat transfer with the linkage 290, the heat fins 291 increase the response time to facilitate control of the gaps 112.

To amplify the axial movement of blade ring 216 based upon the expansion of linkage 290, an amplifying link or second linkage 295 may be utilized. Amplifying link 295 can be pivotally connected to linkage 290, blade ring 216 and outer casing 260. Due to this pivotal connection, a small expansion of linkage 290 translates into a larger movement of blade ring 216 and a resulting larger adjustment of gap 112.

The pivot point 296 along the amplifying link 295 can also be positioned closer or farther away from the center point of the amplifying link to control the amount of amplification. The present disclosure also contemplates other configurations and connections of the amplifying link 295, linkage 290, blade ring 216 and outer casing 260 to facilitate movement of the blade ring with respect to the blade tips 120 including directly connecting the linkage 290 to ring post 270.

Figure 8:
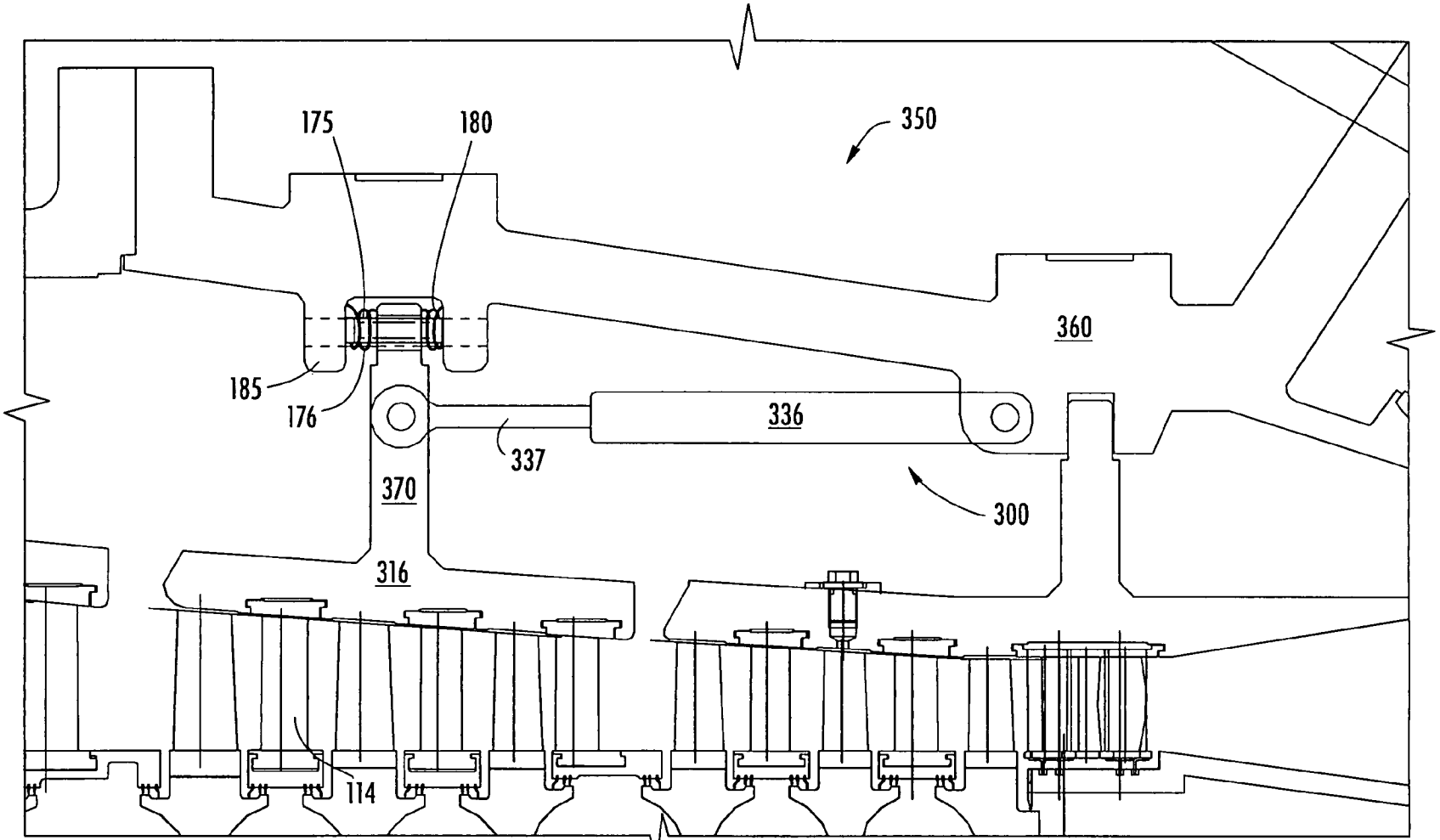
FIG. 8 is a partial cross-sectional view of a blade assembly having a blade gap control system according to a third exemplary embodiment of the invention.

Referring to FIG. 8, a third exemplary embodiment of a blade gap control system 300 may reduce the gap 112 formed between blades 114 and blade rings 316 in the turbine engine 350. System 300 may comprise at least one piston 336 having an arm 337 attached at one end to the blade ring 316. The piston 336 can be air or steam driven. The piston 336 is preferably connected to the outer casing 360 for moving the blade ring 316 axially relative to the blade tips 120, although connection of the piston 336 to other support structures is also contemplated. The arm 337 may be attached to the ring post 370 or other support structure positioned radially outward from the blade ring 316. The piston 336 can also be other numbers of pistons, which are positioned in various configurations to facilitate the axial movement of the blade ring 316 with respect to the blade tips 120.

During pinch point operation, the axial position of the blade ring 316 relative to the blade tips 120 is adjusted by piston 336 to increase the clearance, thereby preventing any rubbing of the blade tips with the blade ring. During base load operation, the axial position of the blade ring 316 relative to the blade tips 120 is adjusted by piston 336 to decrease the clearance, thereby removing the inefficiencies due to leakage.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A blade clearance control system for a turbine engine having an outer casing and a rotor assembly, the system comprising:

a blade ring concentric with the rotor assembly and positioned radially outward from blade tips of the rotor assembly, the blade ring having a radially inner wall that is radially outward of the blade tips to define a gap therebetween; and one or more plenums positioned upstream and downstream of the blade ring, the one or more plenums being selectively pressurized to move the blade ring relative to the blade tips to adjust the gap;

wherein the radially inner wall of the blade ring is oblique to a rotational axis of the rotor assembly, and wherein the one or more plenums move the blade ring axially relative to the blade tips to adjust the gap.

2. The system of claim 1, further comprising at least one guide pin, wherein the blade ring has a post that is slideably connected to the guide pin.

3. The system of claim 1, wherein the one or more plenums are defined in part by a radially outer wall of the blade ring.

4. The system of claim 1, wherein the blade ring comprises a plurality of blade ring segments.

5. The system of claim 1, wherein the one or more plenums are first and second plenums, wherein the blade ring has a post that is slideably connected to the outer casing, and wherein the first and second plenums are selectively pressurized to move the blade ring axially relative to the blade tips to adjust the gap.

6. The system of claim 1, wherein the radially inner wall of the blade ring is at an acute angle with respect to the rotational axis and is substantially equal to a tip angle defined by the blade tips and the rotational axis.

7. The system of claim 1, wherein the blade clearance control system is in the compressor section of the turbine engine.

8. A turbine engine comprising:

an outer casing;

a blade assembly formed from at least one row of blades extending radially from a rotor, wherein the at least one row is formed from a plurality of blades having blade tips;

one or more blade rings positioned radially outward of the blade assembly, wherein a radially inner wall of each of the one or more blade rings is offset radially outward from the blade tips creating gaps and wherein the one or more blade rings are positioned at an acute angle with respect to a rotational axis of the blade assembly; and a gap control system having a first linkage that thermally expands or contracts to move the one or more blade rings axially relative to the blade tips to adjust the gaps.

9. The turbine engine of claim 8, wherein the gap control system has a second linkage, wherein the first linkage is pivotally connected at one end to the outer casing and at the other end to the second linkage.

10. The turbine engine of claim 9, wherein the second linkage amplifies the thermal expansion or contraction of the first linkage.

11. The turbine engine of claim 8, further comprising at least one guide pin, wherein the one or more blade rings slide along the at least one guide pin.

12. The turbine engine of claim 11, wherein the one or more blade rings have a post that is slideably connected to the at least one guide pin.

13. The turbine engine of claim 8, wherein the first linkage is a high alpha material.

14. The turbine engine of claim 8, wherein the first linkage is a shape memory alloy.

15. The turbine engine of claim 8, wherein the one or more blade rings comprise a plurality of blade ring segments each having the first linkage that thermally expands to move the plurality of blade ring segments axially relative to the blade tips to adjust the gaps.

16. The turbine engine of claim 8, wherein the gap control system adjusts the gaps in a compressor section of the turbine engine.

17. A method of blade clearance control in a gas turbine comprising:

positioning a blade ring concentric with a rotor assembly and radially outward from blade tips of the rotor assembly, positioning a radially inner wall of the blade ring oblique to a rotational axis of the rotor assembly, the radially inner wall being radially outward of the blade tips to define a gap therebetween; and supplying a pressurized fluid to the blade ring to selectively create a pressure differential across a portion of the blade ring, the pressure differential moving the blade ring relative to the blade tips to adjust the gap;

aligning the radially inner wall of the blade ring and the blade tips at a substantially equal acute angle with respect to the rotational axis of the rotor assembly.

18. The method of claim 17, further comprising slideably connecting the blade ring to an outer casing of the gas turbine.

* * * * *